US007484621B2

(12) United States Patent
Apps et al.

(10) Patent No.: US 7,484,621 B2
(45) Date of Patent: Feb. 3, 2009

(54) TRAY

(75) Inventors: William P. Apps, Alpharetta, GA (US); Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 434 days.

(21) Appl. No.: 11/223,436

(22) Filed: Sep. 9, 2005

(65) Prior Publication Data

US 2007/0056874 A1 Mar. 15, 2007

(51) Int. Cl.
*B65D 21/06* (2006.01)

(52) U.S. Cl. ..... 206/506

(58) Field of Classification Search ..... 220/506, 220/505, 510, 509, 23.86, 23.83, 773, 769, 220/752, 676, 756; D3/272; D9/907
See application file for complete search history.

(56) References Cited

U.S. PATENT DOCUMENTS

| | | | | |
|---|---|---|---|---|
| 1,082,274 | A | 12/1913 | Lapish | |
| 1,219,969 | A * | 3/1917 | Lowe | 220/756 |
| 1,378,614 | A | 5/1921 | McLeod et al. | |
| 1,732,437 | A * | 10/1929 | Ganzer | 220/756 |
| 2,029,746 | A | 2/1936 | Tufts et al. | |
| 2,061,414 | A | 11/1936 | Tufts et al. | |
| 2,134,875 | A | 11/1938 | Henze | |
| 2,221,504 | A | 11/1940 | Beasley et al. | |
| 2,512,522 | A | 6/1950 | Denny | |
| 2,553,607 | A | 5/1951 | Rosenberg | |
| 2,609,120 | A | 9/1952 | Williams | |
| 2,747,748 | A | 5/1956 | Barefoot | |
| 2,777,627 | A | 1/1957 | Crane | |
| 2,782,950 | A | 2/1957 | Corr | |
| 2,850,204 | A | 9/1958 | Rehrig | |
| RE25,050 | E | 10/1961 | Hamilton | |
| 3,186,585 | A | 6/1965 | Denny | |

(Continued)

FOREIGN PATENT DOCUMENTS

| | | |
|---|---|---|
| CA | 2 069 226 | 4/2003 |

(Continued)

OTHER PUBLICATIONS

United Kingdom Search Report, Dec. 21, 2006.

(Continued)

*Primary Examiner*—Anthony D Stashick
*Assistant Examiner*—Robert J Hicks
(74) *Attorney, Agent, or Firm*—Carlson, Gaskey & Olds

(57) ABSTRACT

A tray includes a floor and a pair of opposed side walls, each having a cutout, one of which is larger to form the dropside. A pair of bail members are pivotably and slidably secured to opposed end walls. The bail members are supported by the end walls at a plurality of selected heights. The bail member is arranged to provide structural support to the dropside of a similar tray stacked thereon. The stiffness of the support is increased by the design of the bail member, which has a support portion with an elongated cross section. The elongated cross section is maintained in a vertical orientation when the bail member is in any of the stacking positions. In this manner, the dropside can have a large cutout without deflecting substantially during use.

34 Claims, 16 Drawing Sheets

U.S. PATENT DOCUMENTS

| | | | | |
|---|---|---|---|---|
| 3,220,603 | A | 11/1965 | Bromley | |
| 3,323,673 | A | 6/1967 | Cowan | |
| 3,360,180 | A | 12/1967 | Venturi | |
| 3,374,915 | A | 3/1968 | Verhein et al. | |
| 3,375,953 | A * | 4/1968 | Miller, Jr. | 206/506 |
| 3,383,028 | A * | 5/1968 | Brander | 206/524.3 |
| 3,685,718 | A | 8/1972 | Chidgey | |
| 3,940,018 | A | 2/1976 | Schoeller | |
| 3,951,265 | A | 4/1976 | Carroll | |
| 3,982,650 | A | 9/1976 | Ichihara | |
| 4,049,113 | A | 9/1977 | Joyce et al. | |
| 4,090,633 | A | 5/1978 | Trubiano | |
| 4,106,623 | A | 8/1978 | Carroll et al. | |
| 4,109,791 | A | 8/1978 | Clipson et al. | |
| 4,214,669 | A | 7/1980 | McQuiston | |
| 4,241,831 | A | 12/1980 | Locatelli | |
| 4,247,004 | A | 1/1981 | Bird | |
| 4,293,069 | A | 10/1981 | Partain | |
| 4,391,369 | A | 7/1983 | Stahl et al. | |
| 4,423,813 | A | 1/1984 | Kreeger et al. | |
| 4,466,541 | A | 8/1984 | Tabler et al. | |
| 4,505,422 | A | 3/1985 | Vossen | |
| 4,508,237 | A | 4/1985 | Kreeger et al. | |
| 4,573,577 | A | 3/1986 | Miller | |
| 4,579,220 | A | 4/1986 | Brundage | |
| RE32,223 | E | 8/1986 | Kreeger et al. | |
| 4,624,381 | A | 11/1986 | Friedrich | |
| 4,643,310 | A | 2/1987 | Deaton et al. | |
| 4,735,331 | A | 4/1988 | Keenan et al. | |
| 4,759,451 | A | 7/1988 | Apps | |
| 4,770,300 | A | 9/1988 | Klein | |
| 4,773,533 | A | 9/1988 | Greene | |
| 4,848,578 | A | 7/1989 | Schafer | |
| 4,863,062 | A | 9/1989 | Holliday | |
| 4,905,833 | A | 3/1990 | Kreeger et al. | |
| 4,946,093 | A | 8/1990 | Moorman | |
| 4,947,992 | A | 8/1990 | Schafer | |
| 4,982,844 | A | 1/1991 | Madan et al. | |
| 5,083,666 | A | 1/1992 | Lam | |
| 5,415,293 | A | 5/1995 | Ackermann | |
| 5,469,986 | A | 11/1995 | Jang | |
| 5,494,163 | A | 2/1996 | Apps | |
| 5,609,254 | A | 3/1997 | Loftus et al. | |
| 5,617,953 | A | 4/1997 | Cope | |
| D381,203 | S | 7/1997 | Ackermann | |
| D382,404 | S | 8/1997 | Cope | |
| 5,752,602 | A | 5/1998 | Ackermann | |
| 5,772,033 | A | 6/1998 | Loftus et al. | |
| 5,881,902 | A | 3/1999 | Ackermann | |
| 5,896,992 | A * | 4/1999 | McGrath | 206/507 |
| 5,924,572 | A | 7/1999 | Cope | |
| 6,059,114 | A | 5/2000 | Loftus | |
| D436,729 | S | 1/2001 | Aiken | |
| 6,382,458 | B2 * | 5/2002 | Mori | 220/763 |
| 6,938,772 | B2 | 9/2005 | Aiken et al. | |
| 7,014,043 | B2 | 3/2006 | Raghunathan et al. | |
| 7,017,745 | B2 | 3/2006 | Raghunathan | |
| 7,249,675 | B2 * | 7/2007 | Hassell et al. | 206/506 |
| 2002/0117420 | A1 | 8/2002 | McDade | |
| 2002/0179480 | A1 | 12/2002 | Raghunathan et al. | |
| 2003/0230510 | A1 | 12/2003 | Aiken et al. | |
| 2005/0224385 | A1 | 10/2005 | Hassell et al. | |
| 2005/0263423 | A1 | 12/2005 | Hassell et al. | |
| 2005/0263424 | A1 | 12/2005 | Hassell et al. | |
| 2006/0065567 | A1 * | 3/2006 | Hassell et al. | 206/506 |
| 2006/0065576 | A1 | 3/2006 | Hassell et al. | |
| 2006/0070906 | A1 * | 4/2006 | Verna et al. | 206/509 |
| 2006/0096883 | A1 * | 5/2006 | Reghunathan et al. | 206/506 |
| 2006/0108372 | A1 | 5/2006 | Aiken et al. | |
| 2006/0118450 | A1 * | 6/2006 | Stahl | 206/506 |
| 2006/0196800 | A1 * | 9/2006 | Baltz | 206/509 |
| 2006/0231449 | A1 | 10/2006 | Hassell et al. | |

FOREIGN PATENT DOCUMENTS

| | | | |
|---|---|---|---|
| DE | 83 03 842.6 | | 1/1984 |
| DE | 35 11 321 | | 10/1986 |
| DE | 35 21 894 | | 1/1987 |
| DE | 35 40 005 | | 1/1987 |
| DE | 41 02 082 | | 7/1992 |
| DE | 295 01 696.5 | | 4/1995 |
| DE | 195 06 228 | | 9/1995 |
| DE | 199 39 019 | | 1/2001 |
| DE | 200 02 537 | | 7/2001 |
| EP | 0 311 174 | | 4/1989 |
| EP | 0 413 884 | | 1/1990 |
| EP | 0 368 713 | | 5/1990 |
| EP | 0 557 002 | | 8/1993 |
| EP | 0 697 341 | | 2/1996 |
| EP | 0 751 074 | | 1/1997 |
| EP | 0 856 469 | | 8/1998 |
| EP | 0 953 509 | | 3/1999 |
| EP | 0 926 073 | | 6/1999 |
| EP | 1 170 223 | | 1/2002 |
| EP | 0 841 254 | | 9/2002 |
| EP | 1241105 | | 9/2002 |
| EP | 0 818 394 | | 1/2003 |
| EP | 1 150 901 | | 5/2003 |
| EP | 1 025 011 | | 4/2004 |
| EP | 0 932 560 | | 1/2005 |
| EP | 1 261 937 | | 1/2005 |
| EP | 1 609 725 | | 3/2007 |
| EP | 1 785 360 | | 5/2007 |
| FR | 1 040 163 | | 10/1953 |
| FR | 2 325 565 | | 9/1975 |
| FR | 2 627 746 | | 2/1988 |
| FR | 2 678 585 | | 1/1993 |
| FR | 2 701 690 | | 2/1993 |
| GB | 916356 | | 4/1961 |
| GB | 947404 | | 1/1964 |
| GB | 1 335 729 | | 10/1973 |
| GB | 2067167 | A | 7/1981 |
| GB | 2 068 338 | | 8/1981 |
| GB | 2090227 | A * | 7/1982 |
| GB | 2 124 588 | | 2/1984 |
| GB | 2 129 401 | | 5/1984 |
| GB | 2 137 167 | | 10/1984 |
| GB | 2 141 778 | | 1/1985 |
| GB | 2149401 | A | 9/1985 |
| GB | 2 171 980 | | 9/1986 |
| GB | 2 174 678 | | 11/1986 |
| GB | 2 180 821 | | 4/1987 |
| GB | 2 209 737 | | 5/1989 |
| GB | 2 255 076 | | 10/1992 |
| GB | 2 257 422 | | 1/1993 |
| GB | 2 245 251 | | 2/1994 |
| GB | 2 296 009 | | 6/1996 |
| GB | 2 283 728 | | 7/1997 |
| GB | 2 287 241 | | 9/1997 |
| GB | 2 330 826 | | 5/1999 |
| GB | 2 333 285 | | 7/1999 |
| GB | 2 313 361 | | 12/1999 |
| GB | 2 340 485 | | 8/2000 |
| GB | 2 350 350 | | 11/2000 |
| GB | 2 340 482 | | 6/2001 |
| GB | 2 330 131 | | 11/2001 |
| GB | 2 373 239 | | 9/2002 |
| GB | 2 373 240 | | 9/2002 |
| GB | 2 374 859 | | 10/2002 |
| GB | 2 345 053 | | 1/2003 |
| GB | 2 359 066 | | 7/2003 |
| GB | 2 425 302 | | 10/2006 |
| GB | 2427606 | | 1/2007 |
| GB | 2 431 917 | | 5/2007 |

| | | | | |
|---|---|---|---|---|
| GB | 2 431 921 | | | 5/2007 |
| GB | 2 431 922 | | | 5/2007 |
| JP | 10086930 | A | * | 4/1998 |
| JP | 2000355323 | A | * | 12/2000 |
| MX | 01001201 | | | 8/2005 |
| NL | 790 5105 | | | 6/1979 |
| NL | 9002518 | | | 6/1992 |
| SE | 210 889 | | | 2/1967 |
| TW | 338405 | | | 8/1998 |
| WO | 93/24378 | | | 12/1993 |
| WO | 98/01352 | | | 1/1998 |
| WO | 00/27716 | | | 5/2000 |
| WO | 00/51900 | | | 9/2000 |
| WO | 00/66440 | | | 11/2000 |
| WO | 03/104094 | | | 12/2003 |
| WO | 2005/100179 | | | 10/2005 |
| WO | 2005/115854 | | | 12/2005 |
| WO | 2006/036868 | | | 4/2006 |

OTHER PUBLICATIONS

International Search Report for PCT/US2005/012473, Oct. 31, 2005.
International Search Report for PCT/US2005/018374, Aug. 24, 2005.
International Search Report for PCT/US2005/034355, Feb. 13, 2006.
United Kingdom Search Report for 0607419.9, Jun. 27, 2006.

* cited by examiner

TRAY

BACKGROUND OF THE INVENTION

This invention relates to a container, and more particularly to a tray having adjustable stacking heights.

A common tray used in bakeries has two end walls for stacking and two shorter side walls for product visibility and to allow nesting. These trays typically nest by rotating alternate trays 90degrees. They are easy to blind stack (i.e. stack above your head where it is difficult to see any locating features). However, the requirement to nest the trays in a 90degree rotation makes the footprint of the nested trays larger than a single tray and results in a low nest ratio, which is limited by the height of the side walls.

In some of the known trays, one of the side walls is shorter than the other, so that it is low enough for removing product even when the trays are stacked. This is commonly called a dropside version. This lower sidewall may also be called a window. When the trays are stacked, it is advantageous for the dropsides to align on the same side of the stack, so that product can be accessed from any of the trays from the same side. However, the dropside is weaker and deflects considerably more than the opposite side.

Sometimes it is desirable for the trays to be stacked at a selected one of two selected heights, in order to minimize the stacking height to that required by the product in the trays at the time. This is usually accomplished by trays that stack at different heights when they are rotated 180 degrees relative to one another. However, this means that the dropsides cannot be on the same side of the stack when the trays are arranged in alternating 180 degree orientations in order to achieve one of the stack heights. Additionally, having two stack heights limits the ability to blind stack and the features to create this often cause the external dimensions of the tray to be larger. The larger tray size reduces the amount of full goods that can be shipped.

SUMMARY OF THE INVENTION

A tray includes a floor and a pair of opposed side walls, each having a cutout, one of which is larger to form the dropside. A pair of bail members are pivotably and slidably secured to opposed end walls. The bail members are supported by the end walls at a plurality of selected heights. Thus, stacking orientation of the trays is independent of the stacking height, and the dropsides can be aligned at any stacking height. The bail member is arranged to provide structural support to the dropside of a similar tray stacked thereon. The stiffness of the support is increased by the design of the bail member, which has a support portion with an elongated cross section. The elongated cross section is maintained in a vertical orientation when the bail member is in any of the stacking positions. In this manner, the dropside can have a large cutout without deflecting substantially during use.

Additionally, when the bail members are moved to a nesting position, the empty trays can be substantially nested within one another, thereby reducing the overall volume of the nested trays.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
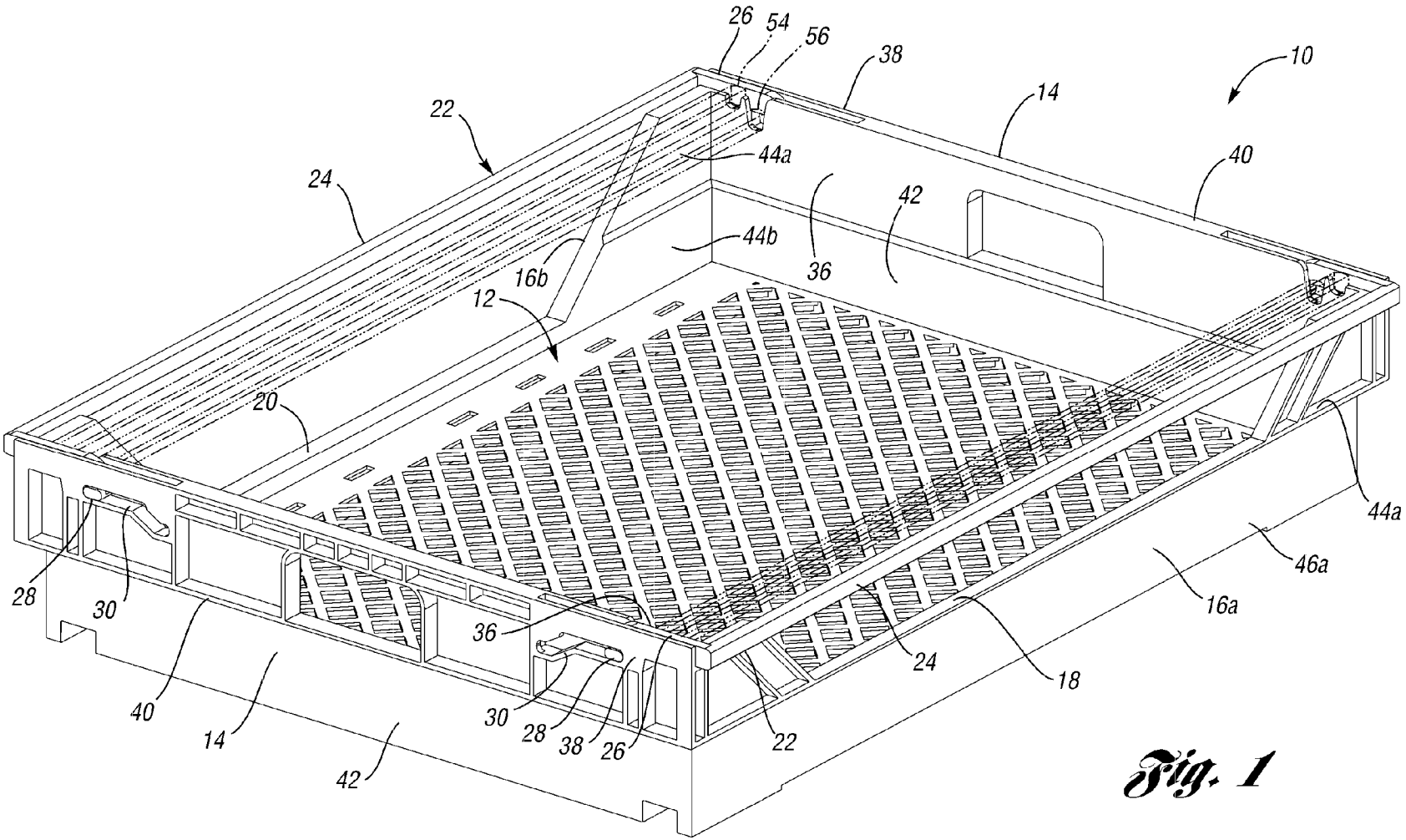
FIG. 1 is a perspective view of a tray according to a first embodiment of the present invention.

A tray 10 according to a first embodiment of the present invention is shown in FIG. 1. The tray 10 includes a floor 12 and a pair of opposed end walls 14 extending upwardly from ends of the floor 12. A first side wall 16*a* extends upwardly from a first side of the floor 12 and a second side wall 16*b* extends upwardly from a second side of the floor 12. The first side wall 16*a* includes a first cutout 18 opening upwardly in a middle portion of the first side wall 16*a*. The second side wall 16*b* includes a second cutout 20 or window opening upwardly in the middle portion of the second side wall 16*b*.

A pair of bail members 22 are pivotably and slidably secured at opposite ends to the end walls 14. Each bail member 22 includes a support portion 24 extending from one end wall 14 to the other. The support portion 24 is connected at each end to a support arm 26 having an elongated pin 28 extending outwardly therefrom. Each pin 28 is trapped in a slot 30 through the end wall 14. The pin 28 can slide freely from one end to the other of the slot 30 and can pivot slightly in the slot 30. At least a portion of each end wall 14 includes an inner wall 36 and an outer wall 38. The arm 26 is between the inner wall 36 and the outer wall 38 so that the pin 28 of the bail member 22 can be received in the slot 30 through the outer wall 38. The inner wall 36 includes a high notch 54 and a low notch 56 for selectively supporting the support portion 24 at different heights (support portion 24 shown in phantom in the high notch 54 and the low notch 56).

Each end wall 14 further includes an upper portion 40 and a lower portion 42, set inwardly from the upper portion 40.

The inner wall 36 and the outer wall 38 form the upper portion 40. The side walls 16*a, b* also each include an upper portion 44*a, b* set outwardly from a lower portion 46*a, b*, respectively.

Figure 2:
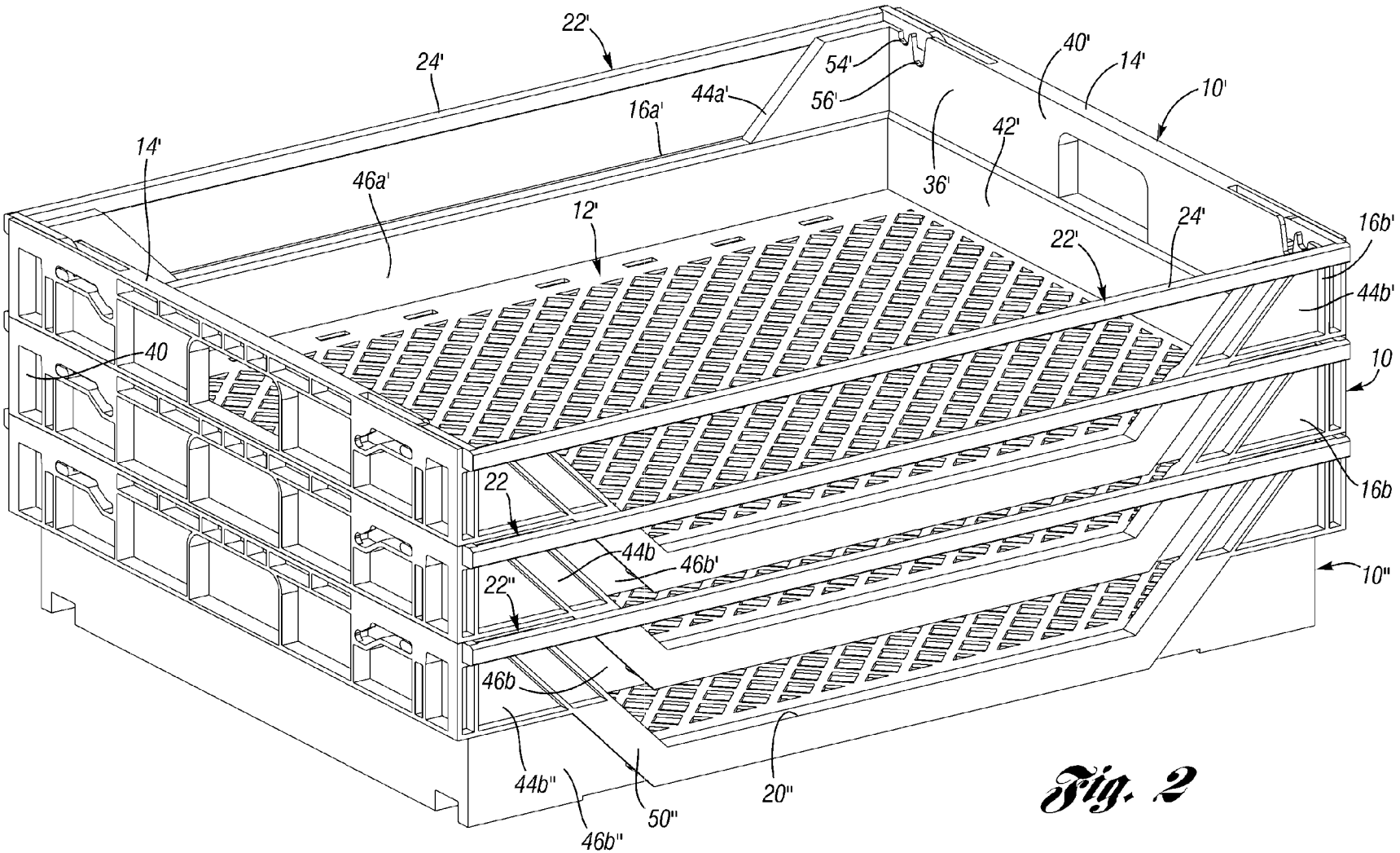
FIG. 2 is a perspective view of the tray of FIG. 1 with a similar tray nested therein and nested in a similar tray.

FIG. 2 is a perspective view of the tray 10 with a similar tray 10' nested therein and nested in a similar tray 10". Referring to the uppermost tray 10', in the nested position, the bail members 22' are positioned such that the support portions 24' are outside the upper portions 44*a,b'* of the side walls 16*a,b'*. The lower portions 46*a,b'* of the side walls 16*a,b'* are fully nested between the upper portions 44*a, b* of the side walls 16*a, b* of the tray 10 below. The lower portions 42' of the end walls 14' are fully nested between the upper portions 40 of the end walls 14 of the tray 10 below. This minimizes the overall stacking height when the trays 10, 10', 10" are empty.

Figure 3:
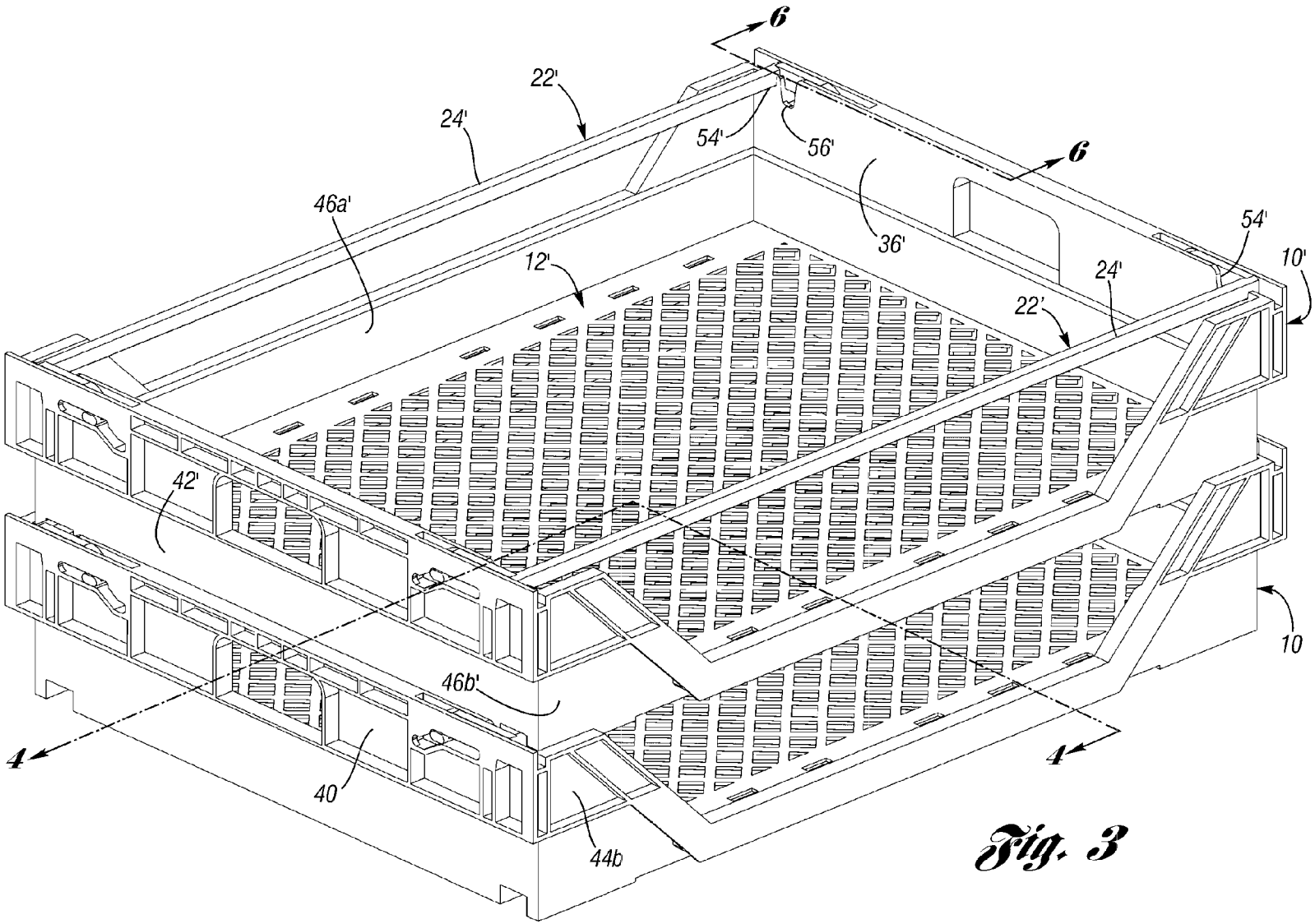
FIG. 3 is a perspective view of the tray of FIG. 1 with a similar tray stacked thereon in a high stack position.

FIG. 3 is a perspective view of the tray 10 with the similar tray 10' stacked thereon. The bail members 22' are positioned such that the support portions 24' are supported in the high notches 54' of the inner wall 36'. The lower portions 46*a,b'* of the upper tray 10' are only slight received between the upper portions 44*a,b* of the lower tray 10.

Figure 4:
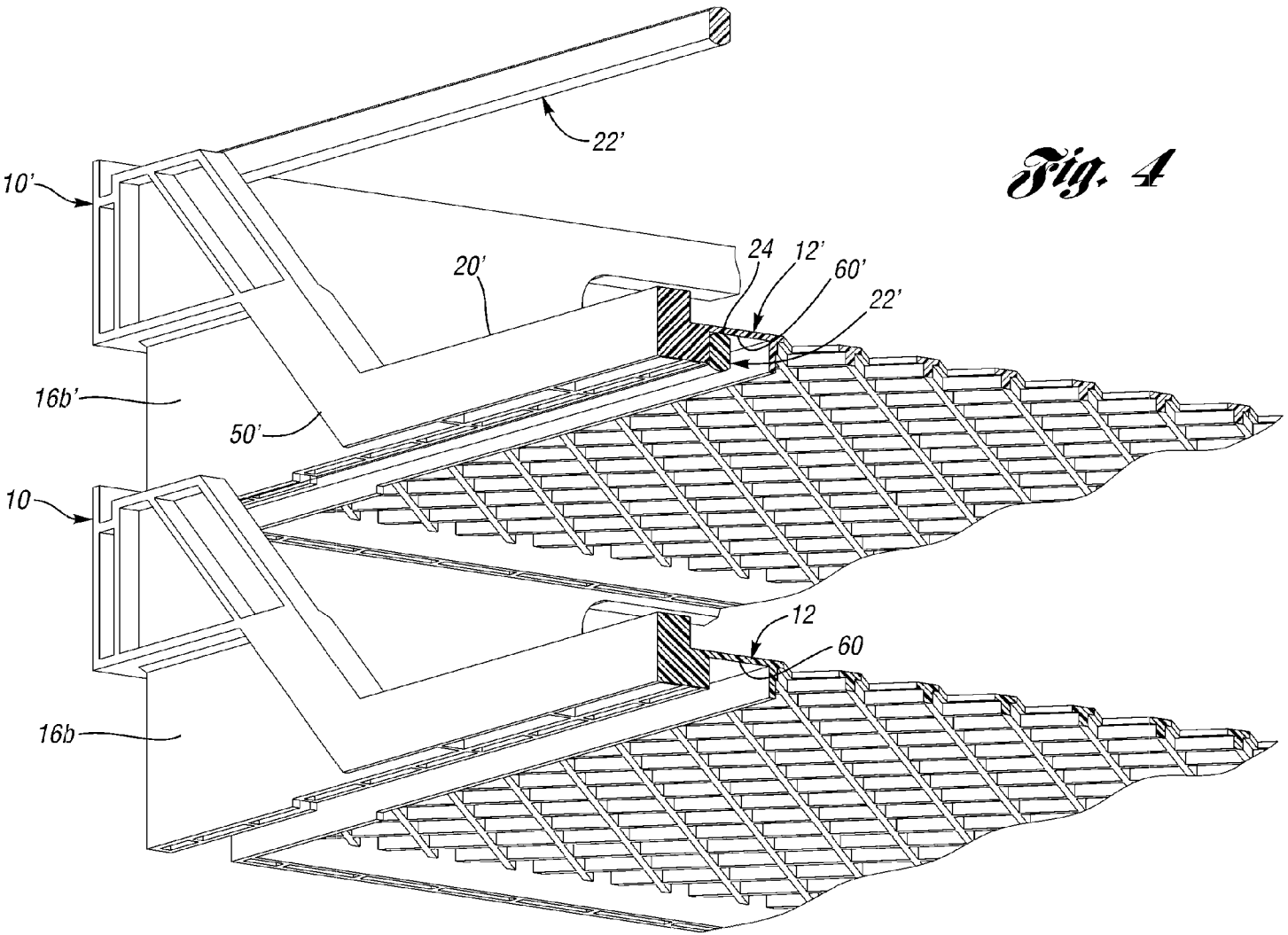
FIG. 4 is a partial sectional view taken along lines 4-4 of FIG. 3.

FIG. 4 is a partial sectional view taken along lines 4-4 of FIG. 3. As shown, the support portion 24 of the bail member 22 of the lower tray 10 is received within a channel 60' formed on the underside of the floor 12' proximate the cutout 20 in the second side wall 16*b'*. The support portion 24 of the bail member 22 contacts the floor 12' of the upper tray 10'. Thus, the second side wall 16*b'*, which is weakened by the large cutout 20', is reinforced by the bail member 22 of the tray 10 below.

Figure 5:
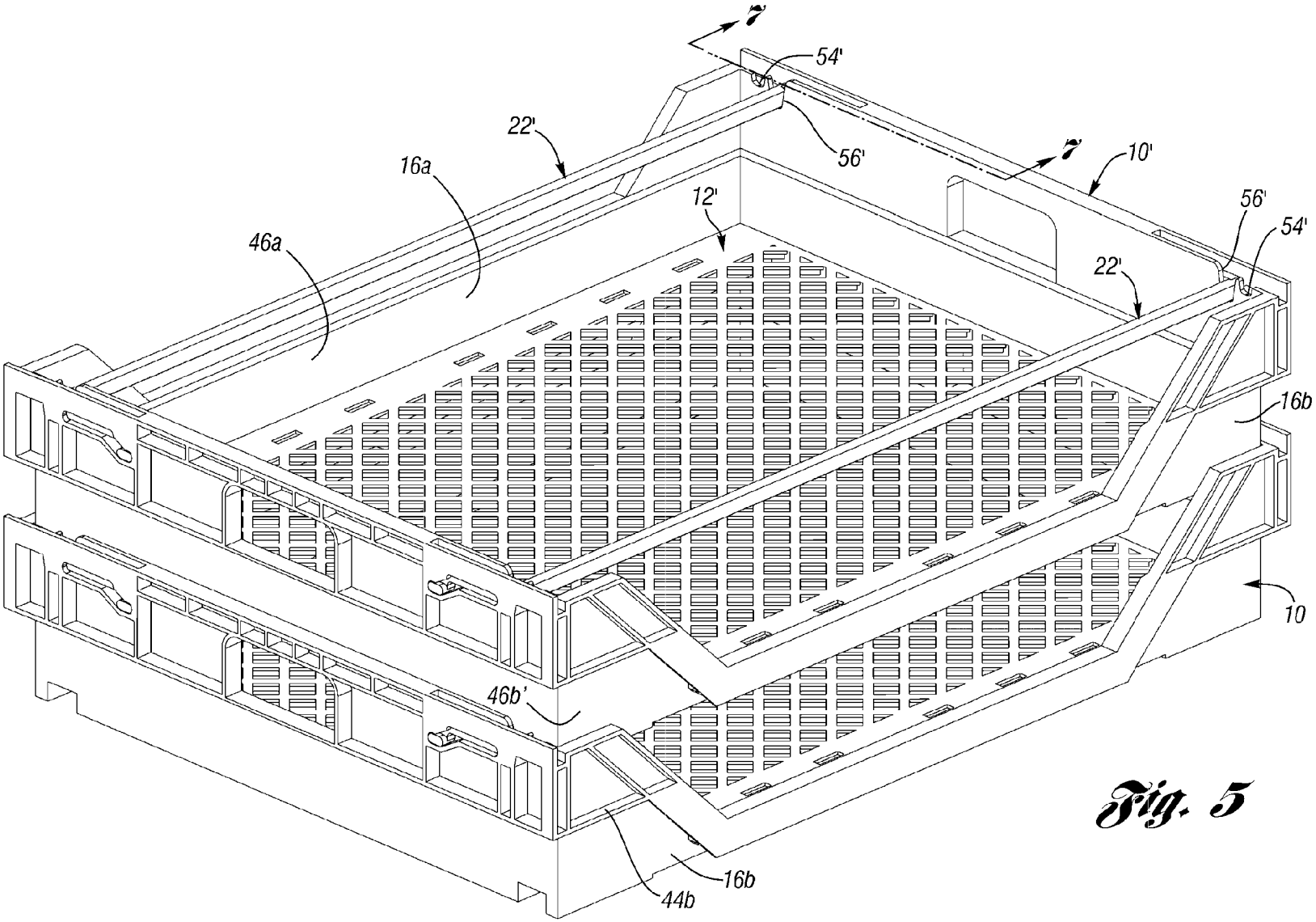
FIG. 5 is a perspective view of the tray of FIG. 1 with a similar tray stacked thereon in a low stack position.

FIG. 5 is a perspective view of the tray 10 with the similar tray 10' stacked thereon in a low stack position. The bail members 22' are positioned with the support portions 24' in the low notches 56' (referring to the upper tray 10', because the bail members in the lower tray 10 are positioned similarly, but not visible). When stacked thereon, the lower portions 46*a,b'* of the side walls 16*a,b'* of the upper tray 10' are partially nested between the upper portions 44*a,b* of the side walls 16*a,b* of the lower tray 10. This provides a reduced stacking height when the trays 10, 10' are loaded with products that permit a lower stacking height.

Figure 6:
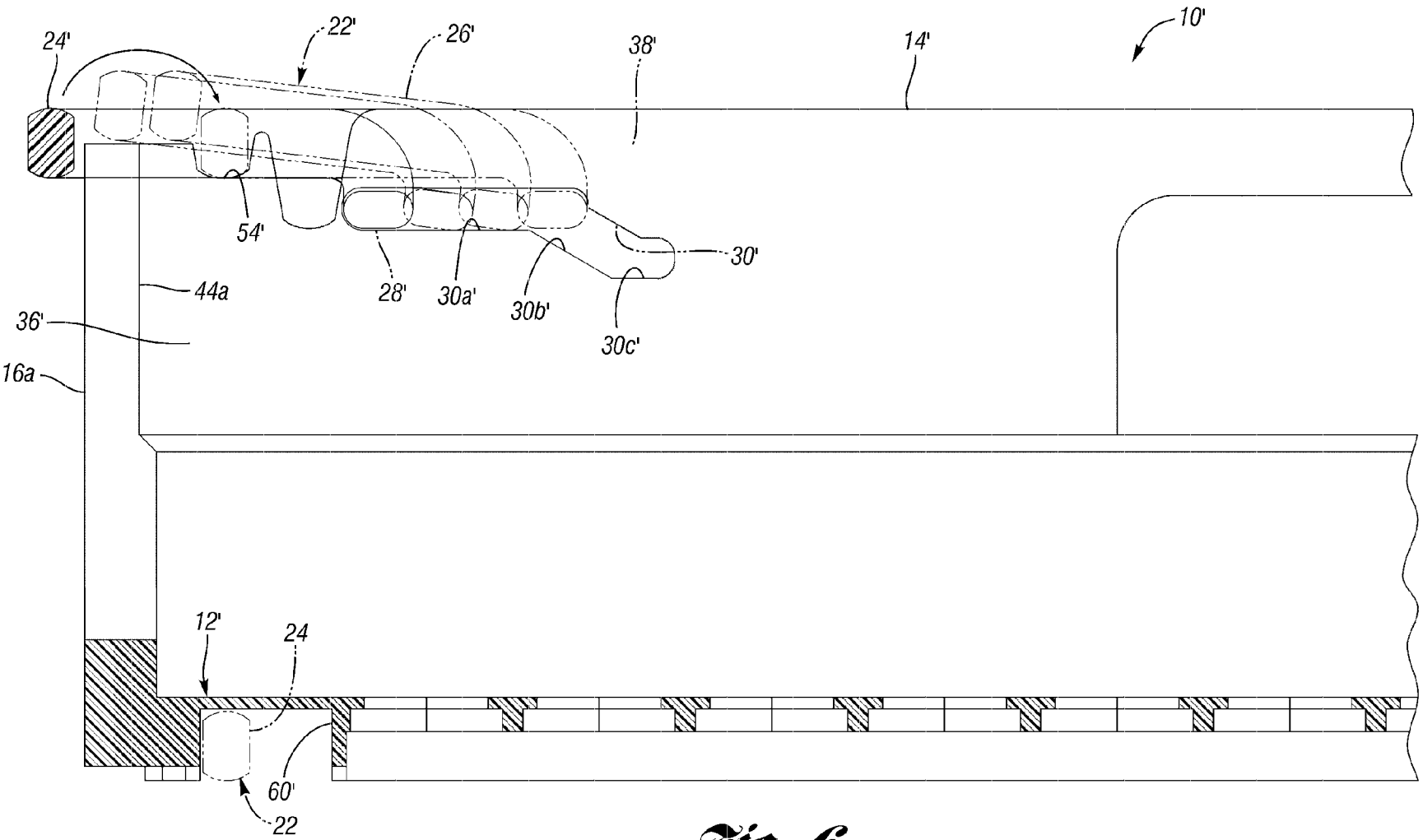
FIG. 6 is a partial perspective view of the tray of FIG. 3 taken along lines 6-6, showing movement of the bail member from the nest position to the high stack position.

FIG. 6 is a partial sectional view of the tray of FIG. 3 taken along lines 6-6, showing movement of the bail member 22' from the nest position to the high stack position. As shown, the support portion 24' of the bail member 22' is positioned outwardly of the upper portion 44*a'* of the first side wall 16*a'* when the bail member 22' is in the nest position. The bail member 22' can be moved from the nest position to the high stack position in the high notch 54' of the end wall 14' in the direction shown. The bail member 22' is pivoted only slightly about the pin 28' during the movement. The elongated pin 28' is captured in the slot 30' in the outer wall 38' of the end wall 14' (the slot 30' and pin 28' are shown in phantom, as they are behind the inner wall 36' in this view). The slot 30' includes a generally horizontal first portion 30*a'* continuous with a sloped second portion 30*b'*, which is continuous with a generally horizontal, short third portion 30*c'*. During movement of the bail member 22' from the nest position to the high stack position, the pin 28' moves from one end of the first portion 30*a'* to the opposite end of the first portion 30*a'*, adjacent the second portion 30*b'*. The pin 28' is elongated horizontally in order to limit rotation of the pin 28' within the slot 30'.

Figure 7:
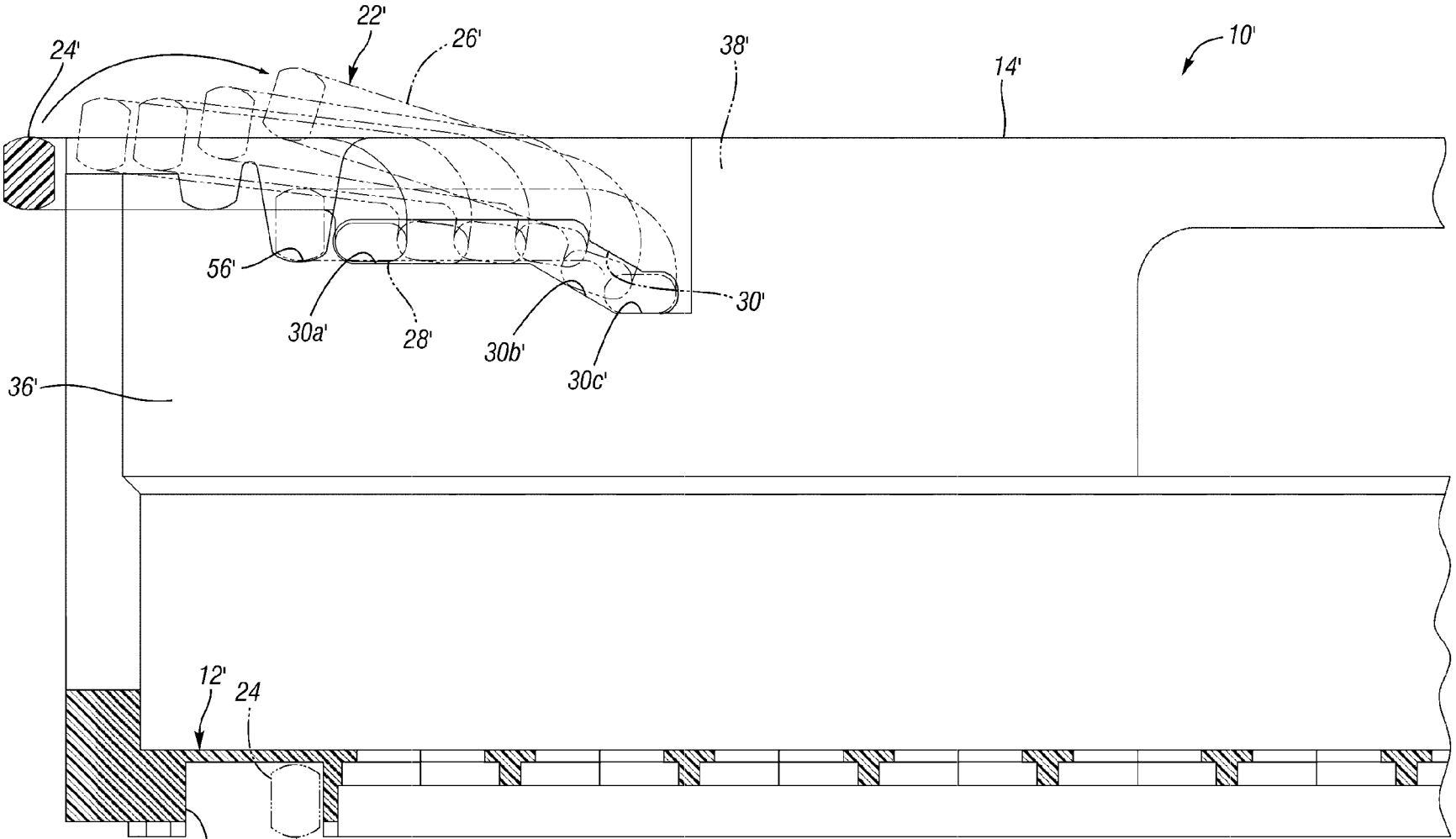
FIG. 7 is a partial perspective view of the tray of FIG. 5 taken along lines 7-7, showing movement of the bail member from the nest position to the low stack position

As can be seen in FIG. 6, the support portion 24' of the bail member 22' has a vertically elongated cross section, which provides more stiffness in the vertical direction. Thus, the support portion 24' of the bail member 22' at least substantially maintains this orientation in the high stack position (FIG. 6) and in the low stack position (FIG. 7). As shown with reference to the bail member 22 of the lower tray 10 (not shown in FIG. 6), the support portion 24 of the bail member 22 is received in the channel 60' formed on the underside of the floor 12' and contacts the floor 12' to provide support.

FIG. 7 is a view similar to that of FIG. 6, but showing movement of the bail member 22' from the nest position to the low stack position, which is also partial sectional view taken along lines 7-7 of FIG. 5. During the movement, the pin 28' slides through the first portion 30*a'* of the slot 30'. The bail member 22' is then pivoted so that the pin 28' can slide through the second portion 30*b'* of the slot 30' to the third portion 30*c'* where the pin 28' returns to its horizontal orientation and, correspondingly, the support portion 24' of the bail member 22' returns to its vertical orientation in the low notch 56'. Since the pin 28' and the support portion 24' have both been moved down the same distance, the orientations of the pin 28' and the support portion 24' are unchanged. Again referring to the bail member 22 of the lower tray 10 (not shown in FIG. 7), the support portion 24 is received within the channel 60' and contacts the floor 12' to support the floor 12'.

Figure 8:
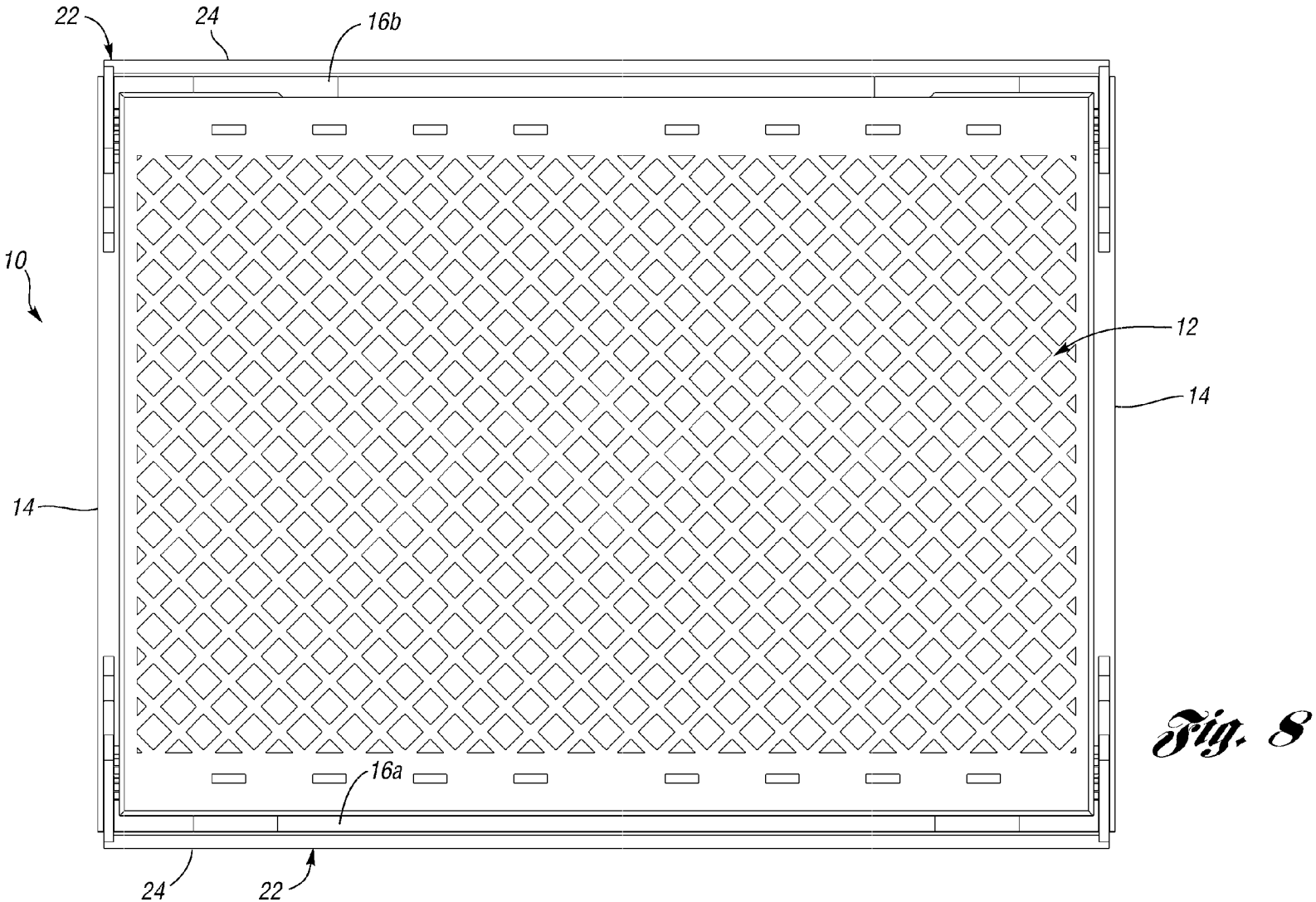
FIG. 8 is a top view of the tray of FIG. 1 with the bail members in the nest position.

FIG. 8 is a top view of the tray 10 of FIG. 1 with the bail members 22 in the nest position outside the side walls 16*a,b*.

Figure 9:
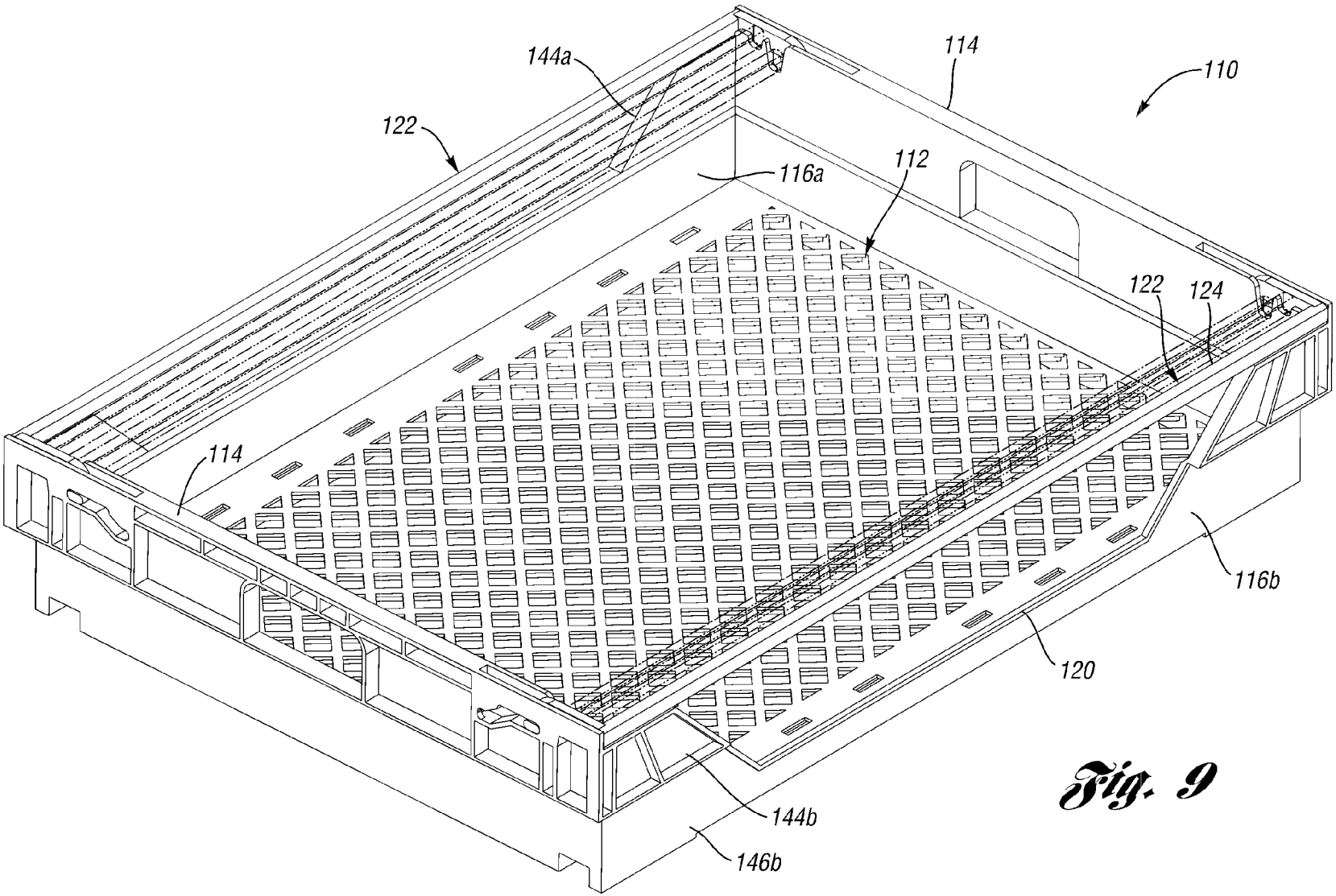
FIG. 9 is a perspective view of a tray according to a second embodiment of the invention showing the bail members in multiple positions.

FIG. 9 is a perspective view of a tray 110 according to a second embodiment of the invention showing the bail members 122 in multiple positions. To the extent not otherwise described or illustrated, the tray 110 is identical to that of FIG. 1 and like reference numerals will be used where possible, with a "1" preappended. The tray 110 includes side walls 116*a,b*. In this embodiment, the bail members 122 are vertically aligned with the upper portions 144*a,b* of the side walls 116*a,b* when in the nest position. This decreases the overall footprint of the tray 110 in the nested position.

Figure 10:
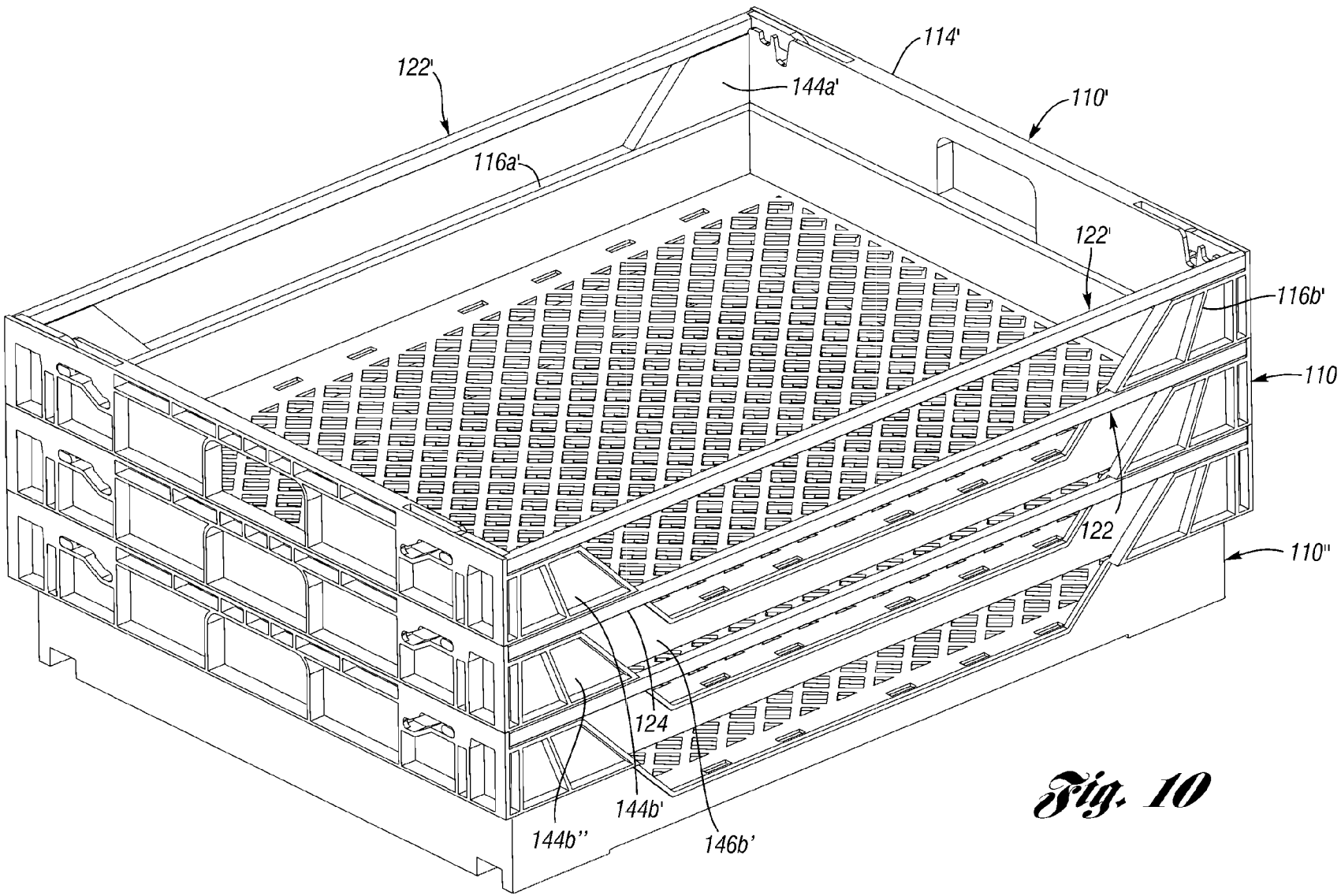
FIG. 10 is a perspective view of the tray of FIG. 9 nested in a similar tray and with a similar tray nested therein.

FIG. 10 is a perspective view of the tray 110 of FIG. 9 nested in a similar tray 110" and with a similar tray 110' nested therein. In this embodiment, the band 50 (FIG. 1) of the first embodiment is removed so that the support portion 124 of the bail member 122 directly abuts the underside of the upper portions 144*a,b'* of the side walls 16*a,b'* and the outer surface of the lower portions 146*a, b'*.

Figure 11:
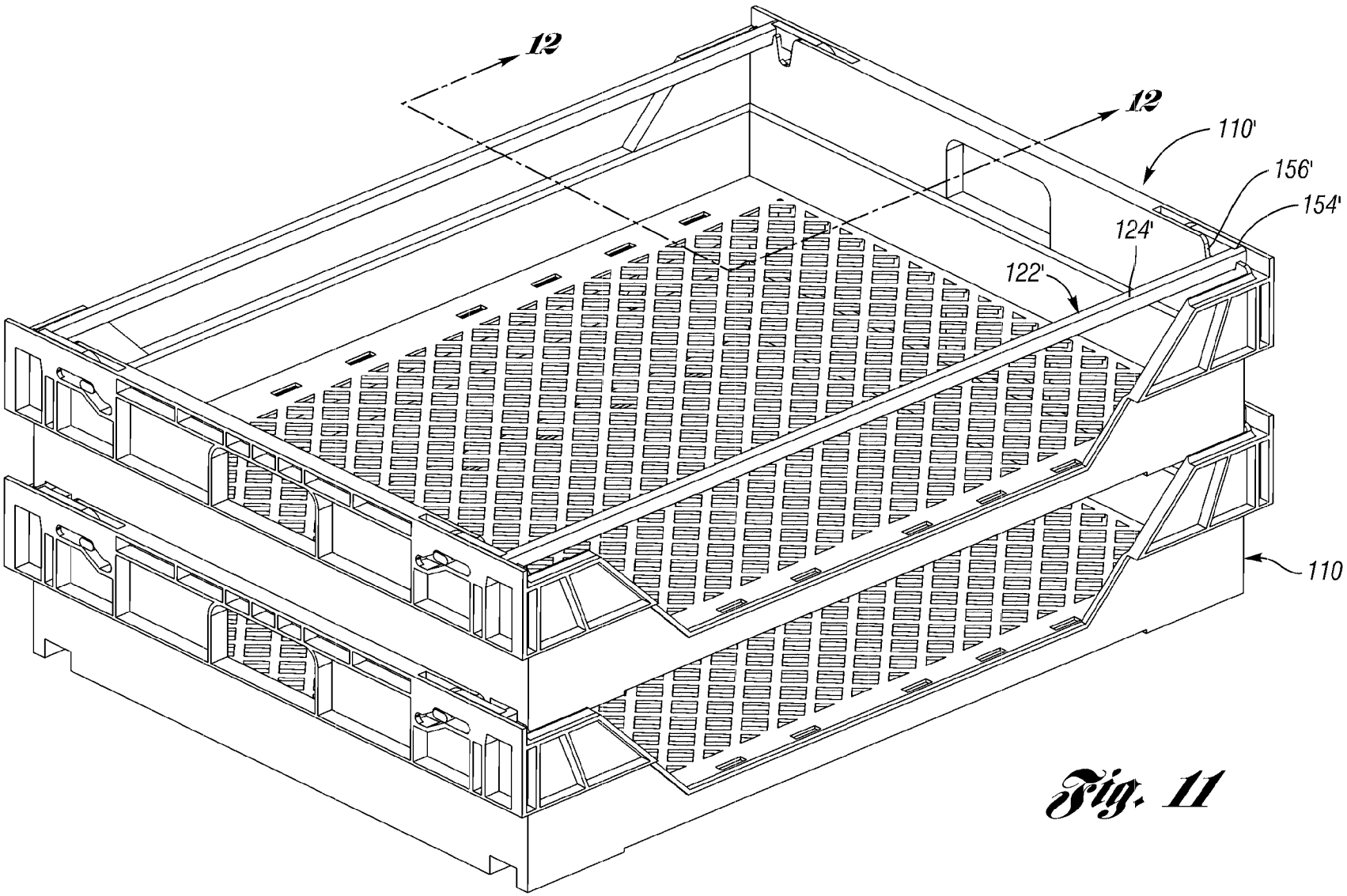
FIG. 11 is a perspective view of the tray of FIG. 9 with a similar tray stacked thereon in a high stack position.

FIG. 11 is a perspective view of the tray 110 of FIG. 9 in a high stack position with a similar tray 110' stacked thereon. The support portion 124' is supported in the high notch 154'.

Figure 12:
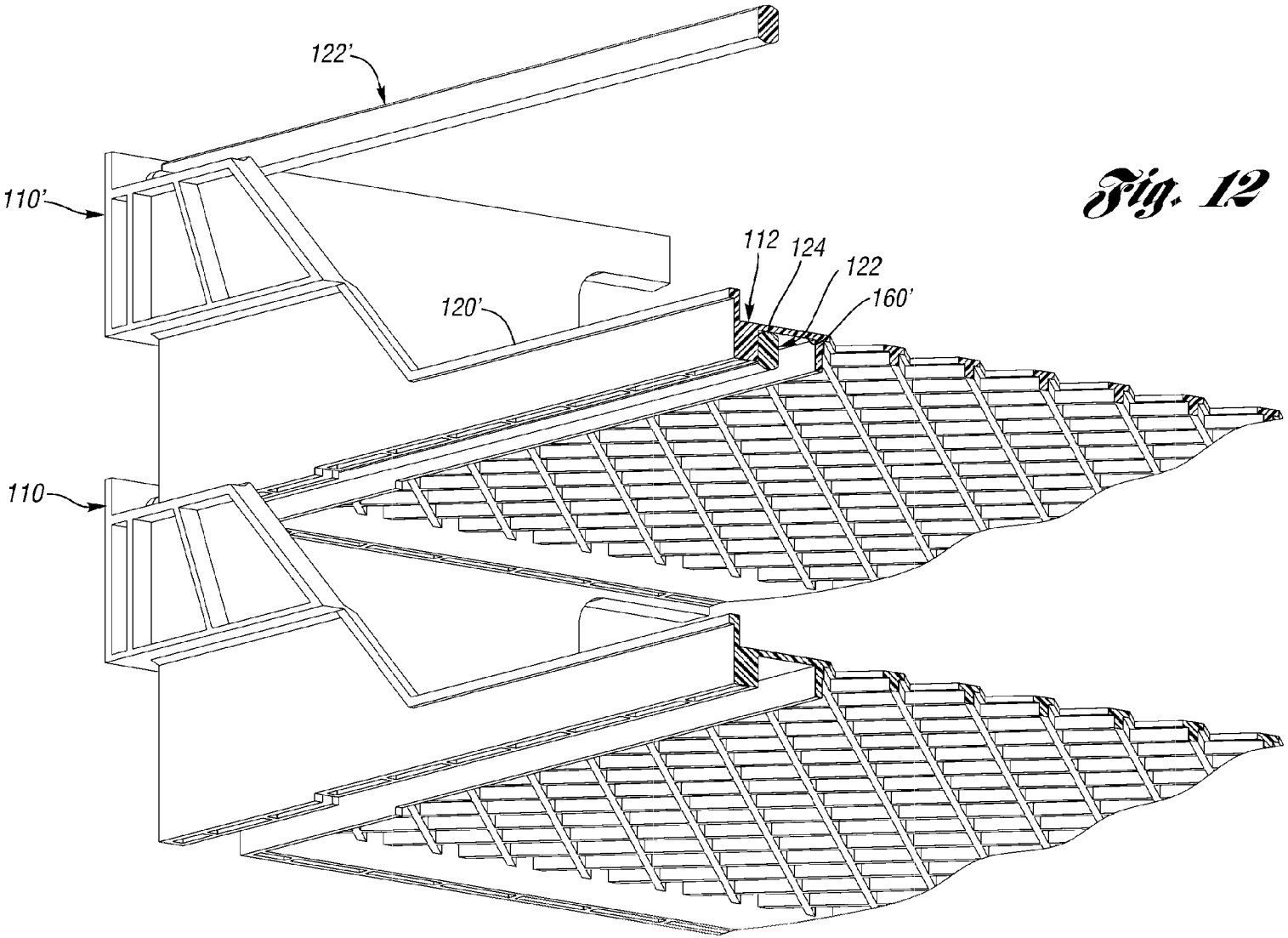
FIG. 12 is a partial sectional view taken along lines 12-12 of FIG. 11.

FIG. 12 is a partial sectional view taken along lines 12-12 of FIG. 11. Like the previous embodiment, the support portion 124 of the lower tray 110 is received within the channel 160' in the underside of the floor 112' and contacts the floor 112' to provide reinforcement.

Figure 13:
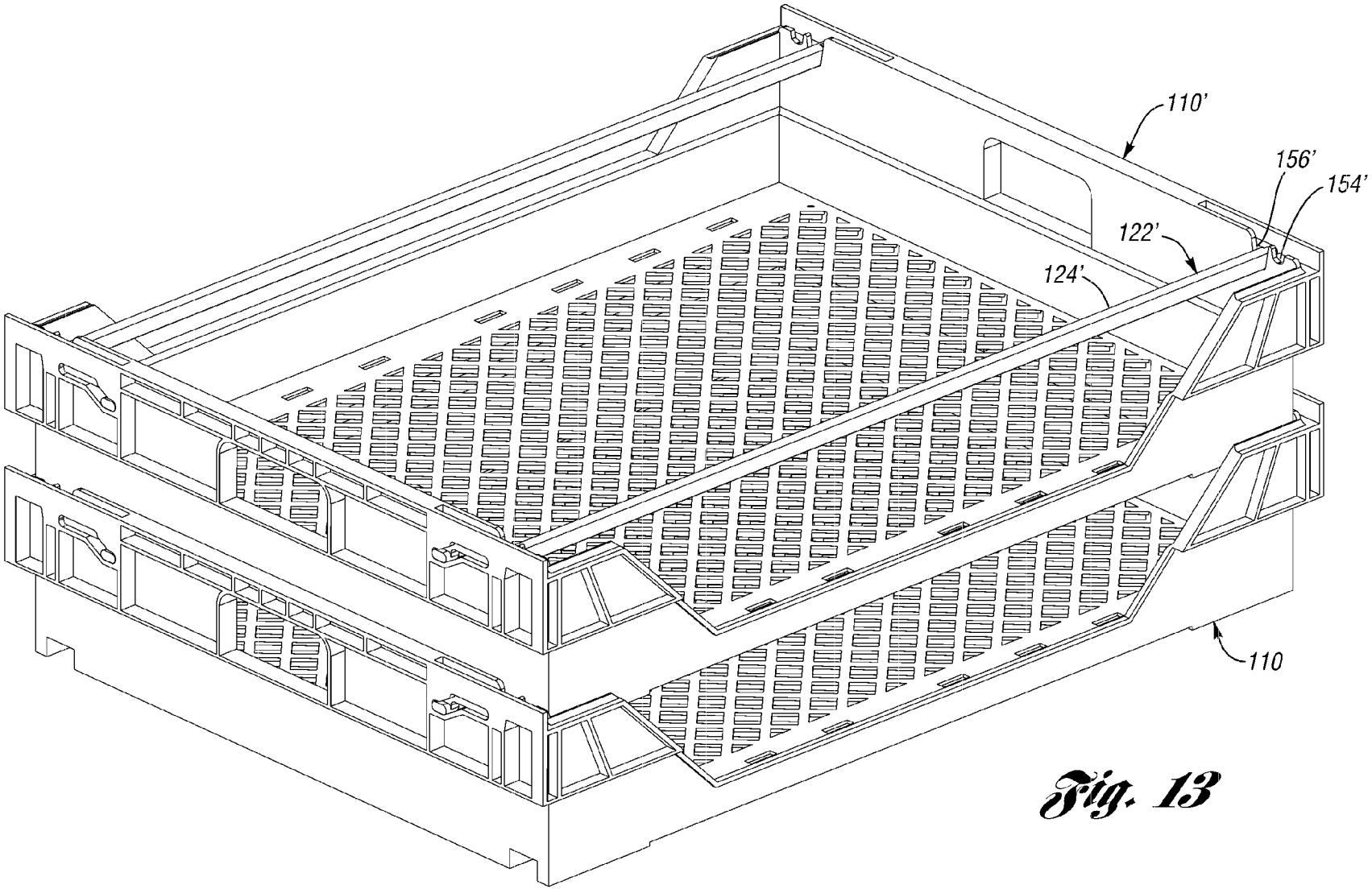
FIG. 13 is a perspective view of the tray of FIG. 9 with a similar tray stacked thereon in a low stack position.

FIG. 13 is a perspective view of the tray 110 of FIG. 9 with a similar tray 110' stacked thereon in a low stack position. The support portions 124' are received in the low notches 156'.

Figure 14:
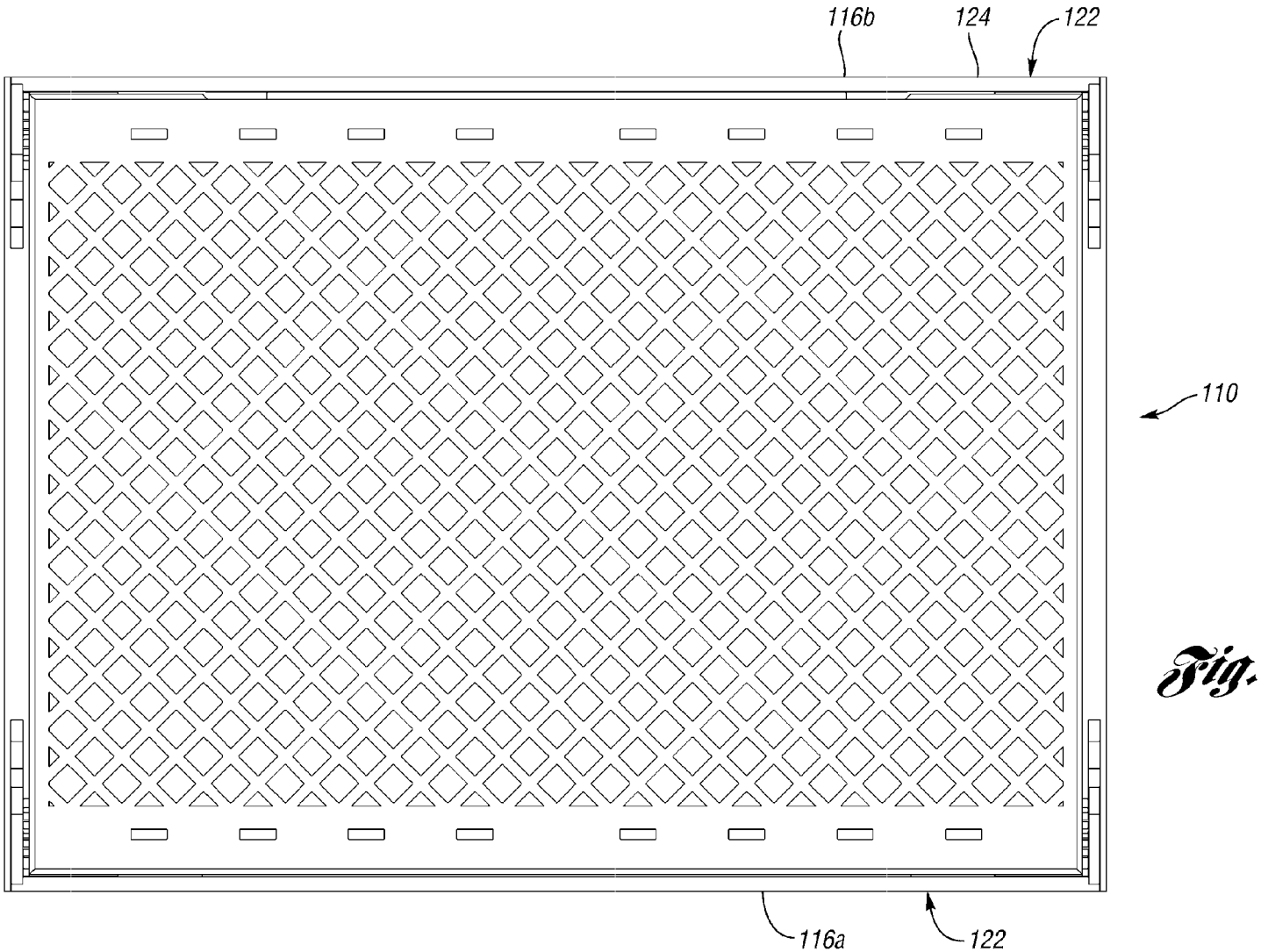
FIG. 14 is a top view of the tray of FIG. 9 with the bail members in the three possible positions.

FIG. 14 is a top view of the tray of FIG. 9 with the bail members 122 shown in the nest position (and shown in the two stack positions in phantom). In this embodiment, the support portions 124 of the bail members 122 are vertically aligned with the side walls 116*a,b* when in the nest position.

Figure 15:
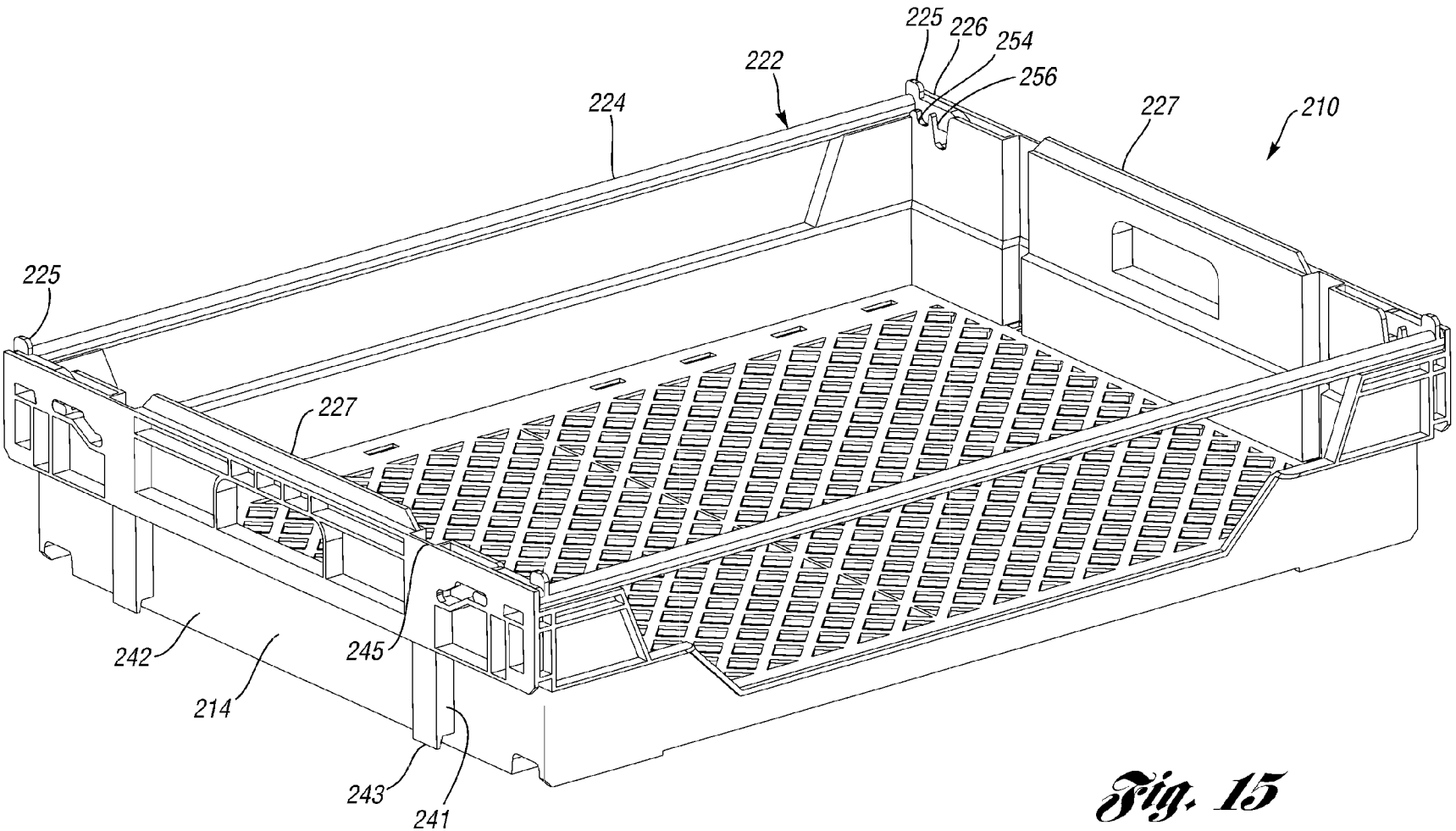
FIG. 15 is perspective view of a tray according to a third embodiment of the present invention.

FIG. 15 is perspective view of a tray 210 according to a third embodiment of the present invention. Except as otherwise illustrated or described, the tray 210 is identical to the tray 110. Each bail member 222 includes a locating feature 225 projecting upwardly from the corners where the support portion 224 joins the arms 226. The locating feature is generally perpendicular to the support portion 224 and arms 226. The locating feature assists with blind stacking, by assisting the proper location of a prior art trays onto the tray 210, as shown in more detail in FIG. 16, described below.

Each side wall 214 includes a rail 227 extending upwardly from a middle portion thereof. Each rail 227 is aligned between the locating features 225 on opposite bail members 222. Each side wall 214 further includes a pair of columns 241 projecting outwardly. A foot 243 is formed at the bottom of each column 241. The foot is spaced outwardly from the side wall 214. The rail 227 and feet 243 make the tray 210 more compatible with existing tray designs in a manner that will be described below.

Figure 16:
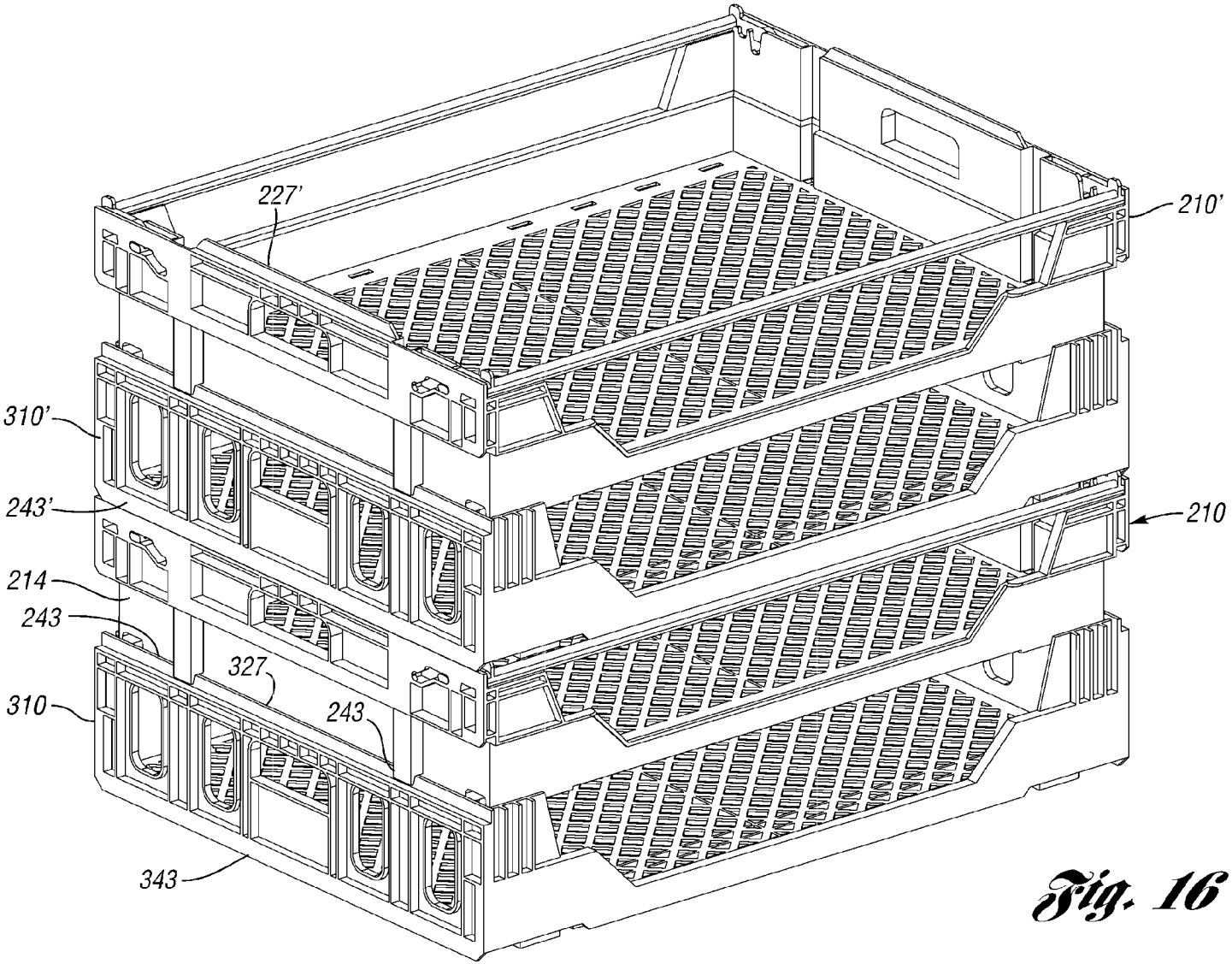
FIG. 16 is a perspective view of the tray of FIG. 15 stacked on prior art trays and with a prior art tray stacked thereon.

FIG. 16 is a perspective view of the tray 210 of FIG. 15 stacked on a prior art tray 310 and with a prior art tray 310'stacked thereon. The feet 243 receive a rail 327 of the prior art tray 310, such that the rail 327 is received between the feet 243 and the end wall 214. The rail 227 (not visible) and the locating features 225 are received behind a foot flange 343' of a prior art tray 310' stacked on the tray 210. This improves the stability of the stack and the compatibility of the tray 210 with the prior art trays 310, 310'.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A tray comprising:

a floor;

a pair of opposed end walls extending upwardly from opposite ends of the floor;

a first side wall extending upwardly from a first side of the floor to a first minimum wall height;

a second side wall extending upwardly from a second side of the floor, the second side wall having an upwardly opening cutout extending to a second minimum wall height, lower than the first minimum wall height; and a bail member movably mounted to the end walls, the bail member having a support portion between the end walls, the bail member movable to a first stack position where the support portion is positioned at a first height above the floor and proximate the cutout in the second side wall.

2. The tray of claim 1 wherein the support portion of the bail member has a cross-section elongated in a direction at least substantially perpendicularly to the floor.

3. The tray of claim 1 wherein the bail member is slidable relative to the end walls to a second stack position at a second height above the floor less than the first height.

4. The tray of claim 3 wherein the bail member is slidable relative to the end walls to a nest position where the support portion is positioned outward of the floor.

5. The tray of claim 4 wherein the support portion of the bail member has a cross-section elongated in a direction at least substantially perpendicularly to the floor when the bail member is in the first stack position and when the bail member is in at least one of the nest position and the second stack position.

6. The tray of claim 1 wherein the second side wall includes an upper side wall portion and a lower side wall portion, the lower side wall portion offset inwardly from the upper side wall portion.

7. The tray of claim 6 wherein the bail member is slidable relative to the end walls to a nest position where the support portion is aligned with the upper side wall portion of the second side wall.

8. The tray of claim 1 wherein the bail member further includes an arm pivotably connecting the bail member to the end wall, the bail member having a first orientation relative to the floor when the bail member is in the first stack position and when the bail member is in the second stack position.

9. The tray of claim 1 wherein the first side wall includes a cutout opening upwardly, the first minimum wall height defined below the cutout.

10. The tray of claim 1 wherein the bail member is movable to a nest position in which the support portion of the bail member is positioned outwardly of the second side wall.

11. The tray of claim 1 wherein the bail member is pivotably and slidably mounted to the end walls.

12. The tray of claim 1 having a like tray stacked thereon, the bail member positioned in the first stack position, the support portion of the bail member in contact with a floor of the like tray proximate a cutout in a second side wall of the like tray, such that the bail member of the tray reinforces the floor and the second side wall proximate the cutout.

13. A tray comprising:

a floor;

a pair of opposed end walls extending upwardly from opposite ends of the floor;

a first side wall extending upwardly from a first side of the floor;

a second side wall extending upwardly from a second side of the floor, the second side wall having an upwardly opening cutout; and a bail member movably mounted to the end walls, the bail member having a support portion between the end walls, the bail member movable to a first stack position where the support portion is positioned at a first height above the floor and to a second position spaced laterally from the first position, the support portion having an elongated cross section which is oriented vertically when the bail member is in the first stack position and when the bail member is in the second position.

14. The tray of claim 13 wherein the second position is a second stack position, the support portion of the bail member vertically aligned with the floor when the bail member is in the first stack position and when the bail member is in the second stack position, the support portion of the bail member at a second height above the floor when the bail member is in the second stack position, the second height different from the first height.

15. The tray of claim 13 wherein the second position is a nest position, the support portion of the bail member vertically aligned with the floor when the bail member is in the first stack position and vertically aligned outward of the floor when the bail member is in the nest position.

16. The tray of claim 13 wherein the second side wall includes an upper portion and a lower portion, the lower portion set inwardly from the upper portion, such that a lower portion of a like tray could nest within the upper portion of the tray.

17. The tray of claim 16 wherein the cutout is formed through the upper portion and the lower portion of the second side wall.

18. The tray of claim 13 further including handles formed through the end walls at a handle height above the floor, the cutout in the second side wall extending lower than the handles.

19. The tray of claim 13 further including an upwardly opening cutout in the first side wall, the cutout defining a first minimum wall height below the cutout, the cutout in the second side wall defining a second minimum wall height below the cutout, the second minimum wall height lower than the first minimum wall height.

20. The tray of claim 13 wherein the cutout is significantly larger than half a height of the second side wall.

21. The tray of claim 13 wherein the first and second side walls each include upper portions and lower portions, the lower portions set inwardly from the upper portions such that the lower portions have outer surfaces that are disposed inwardly of inner surfaces of the upper portions.

22. The tray of claim 21 wherein the cutout is formed through the upper portion and the lower portion of the second side wall.

23. A tray comprising:

a floor;

a pair of end walls extending upwardly from the floor to a tray height a first side wail extending upwardly from a first side of the floor to the tray height the first side wail including a upwardly opening first cutout along a majority of a length of the first side wail;

a second side wail extending upwardly from a second side of the floor to the tray height the second side wail having an upwardly opening cutout extending along a majority of a length of the second side wall, the cutout extending trough morn than half of a height of the second sidewall; and a bail member movably mounted to the end walls, the bail member having a support portion between the end walls, the bail member movable to a first stack position where the support portion is positioned at a first height above the floor and to a second stack position where the support portion is positioned a second height above the floor, the second height greater than the first height.

24. The tray of claim 23 further including a channel formed on the underside of the floor and vertically aligned with the support portion in the first stack position.

25. The tray of claim 24 wherein the channel is also vertically aligned with the support portion in the second stack position.

26. The tray of claim 23 wherein the bail member is pivotably and slidably mounted to the end walls.

27. The tray of claim 23 wherein at least one of the end walls includes a slot into which a pin on the bail member is slidably received, the pin having an elongated cross section that limits rotation of the pin in the slot.

28. The tray of claim 23 wherein the bail member includes at least one locating feature projecting upwardly.

29. The tray of claim 28 wherein the locating feature projects perpendicularly to the support portion and an arm of the bail member.

30. The tray of claim 23 further including at least one foot spaced outwardly from an outer surface of at least one of the end walls.

31. The tray of claim 1 wherein the support portion is generally parallel to the second side wall.

32. The tray of claim 1 wherein the bail member is generally transverse to the end walls.

33. The tray of claim 13 wherein the bail member extends generally from one end wall to the other end wall.

34. The tray of claim 23 wherein the bail member is movably mounted at opposite ends to the end walls.

* * * * *

UNITED STATES PATENT AND TRADEMARK OFFICE

CERTIFICATE OF CORRECTION

PATENT NO. : 7,484,621 B2
APPLICATION NO. : 11/223436
DATED : February 3, 2009
INVENTOR(S) : Apps et al.

It is certified that error appears in the above-identified patent and that said Letters Patent is hereby corrected as shown below:

ON THE TITLE PAGE (ITEM 54) & COL.1:

Please change the title of the patent from "TRAY" to --TRAY WITH ADJUSTABLE STACKING HEIGHTS--

Signed and Sealed this

Twenty-fifth Day of August, 2009

David J. Kappos

David J. Kappos
*Director of the United States Patent and Trademark Office*